United States Patent [19]

Lagerstedt

[11] 4,096,608

[45] Jun. 27, 1978

[54] DRILL STRING HOLDER

[75] Inventor: John Arne Lagerstedt, Skarholmen, Sweden

[73] Assignee: Atlas Copco Aktiebolag, Nacka, Sweden

[21] Appl. No.: 749,163

[22] Filed: Dec. 9, 1976

[30] Foreign Application Priority Data

Dec. 11, 1975 Sweden ..... 7513972

[51] Int. Cl.[2] ..... A44B 21/00; E21C 11/00

[52] U.S. Cl. ..... 24/249 R; 81/57.33; 166/77.5; 175/220; 269/32

[58] Field of Search ..... 24/263 D, 263 DA, 263 DH, 24/263 DB, DIG. 26, 249 R; 81/57.33, 57.34, 57.15, 57.2, 57.19, 57.21; 269/32; 173/149; 166/77.5; 175/220

[56] References Cited

U.S. PATENT DOCUMENTS

| | | | |
|---|---|---|---|
| 2,351,887 | 6/1944 | Steadman | 24/263 DH |
| 2,586,784 | 2/1952 | Capp et al. | 173/149 |
| 2,858,893 | 11/1958 | Waggener | 166/77.5 |
| 2,985,455 | 5/1961 | Powell | 81/57.34 |
| 3,692,320 | 9/1972 | Lindelof et al. | 173/149 |
| 3,696,872 | 10/1972 | Jonsson | 173/149 |

*Primary Examiner*—Kenneth J. Dorner
*Attorney, Agent, or Firm*—Flynn & Frishauf

[57] ABSTRACT

A drill string holder for a rock drilling machine has two jaws opposite each other for gripping a drill string, e.g. the drill string in core drilling with a diamond drill bit. The jaws are forced into their gripping positions by means of a heavy spring. A first selectively actuatable hydraulic piston is arranged to overcome the spring and permit the jaws to release their grip. A selectively actuatable second piston is located inside the first piston. By means of the second piston, the operator can apply a selectively variable force to the jaws when the jaws are released from the spring. This permits the operator to let the drill string gently down into the bore hole by applying a controlled braking force on it.

24 Claims, 3 Drawing Figures

DRILL STRING HOLDER

This invention relates to a drill string holder (pipe holder) for a rock drilling machine, comprising two jaws opposite each other, a compression spring operatively coupled between the jaws to force them towards each other into their gripping position, and a first hydraulically actuated piston device for compressing the spring and permit the jaws to be separated.

It is an object of the invention to provide a simple and inexpensive device that permits controlled letting down of a drill string in a bore hole, for example as is desirable particularly in diamond drilling.

DETAILED DESCRIPTION OF PREFERRED EMBODIMENT

Figure 1:
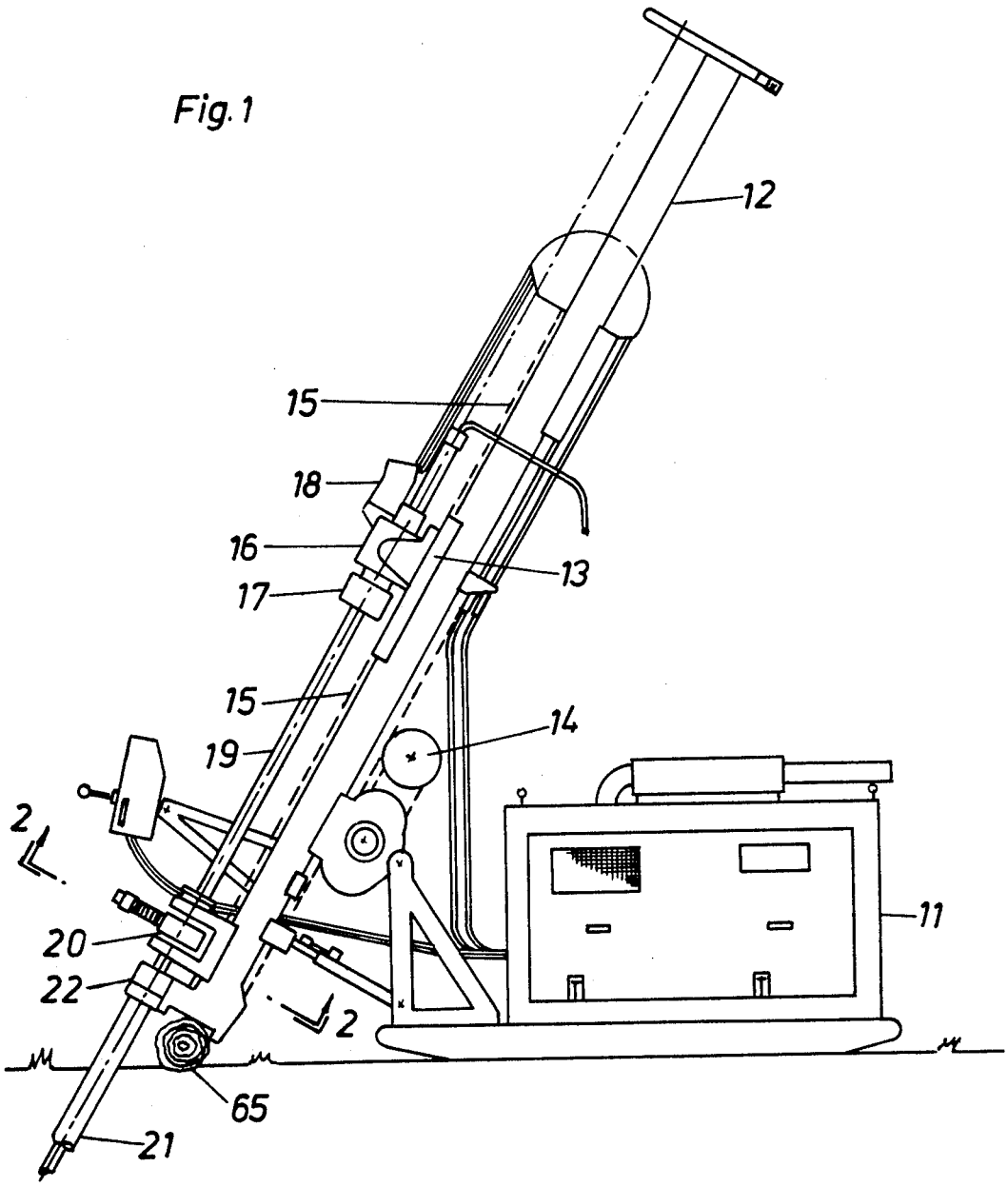
FIG. 1 is an elevational view of a diamond drilling machine provided with a drill string holder according to the invention.

The drilling machine according to FIG. 1 is a so called diamond drilling machine that is used mainly for prospecting purposes when it is wanted to collect a core. It comprises a frame 11 with a fellable mast or feed beam 12 along which a slide 13 can be fed back and forth by means of a feed motor 14 and chains 15. The feed beam 12 is axially displaceable so that it can take support for instance against a log 65. The slide 13 carries a rotation unit 16 with a hydraulic chuck 17 that is rotated by a hydraulic motor 18. Feed force and rotation are transmitted to the drill string (drill pipe) 19 by means of the chuck 17. A drill string holder (pipe holder) 20 is mounted on the feed beam. The drill pipe 19 can be drilled through a lining pipe 21. The feed beam 12 is attached to the lining pipe 21 at 22.

Figure 2:
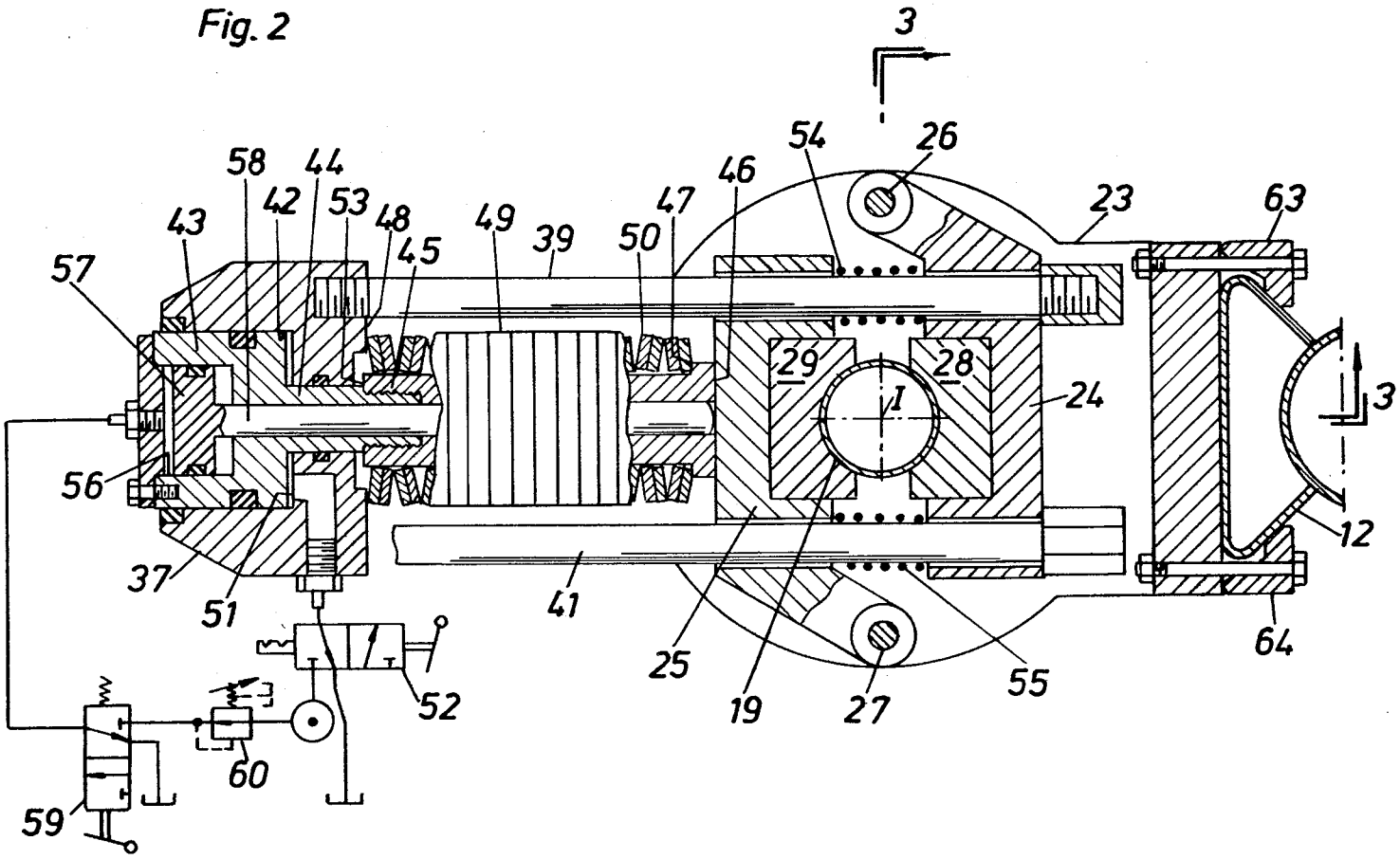
FIG. 2 is a section through the drill string holder of FIG. 1 partly taken along line 2—2 in FIGS. 1 and 3 and partly taken centrally through pistons shown in FIG. 2.
Figure 3:
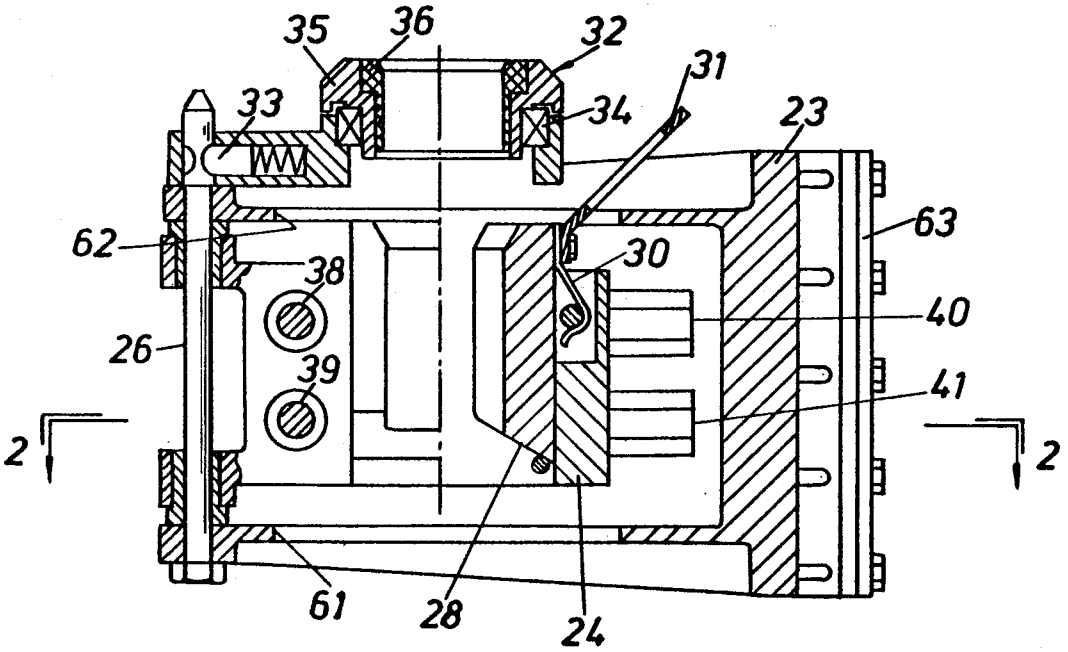
FIG. 3 is a section taken along line 3—3 in FIG. 2.

As best seen in FIGS. 2 and 3, the pipe holder 20 has an open housing 23 that is clamped onto the feed beam by means of brackets 63, 64 that are screwed to the housing. In the housing 23, two jaws 24, 25 are pivotably journalled on rods 26, 27. The axes of the rods 26, 27 and the drill axis lie in a common plane. The jaws 24, 25 have detachable inserts 28, 29 that are affixed to snap locks in the form of springs (FIG. 3) 30. The inserts have handles 31. A pipe guide 32 is affixed by snap locks 33 on the rods 26, 27. The pipe guide 32 comprises a sleeve 35 journalled by means of a bearing 34. The sleeve 35 has a bushing 36 of a plastic. Both the inserts 28, 29 of the jaws and the pipe guide 32 can thus be quickly replaced if it is desired to change to another pipe dimension. Another advantage with this attachment is that the inserts 28, 29 of the jaws as well as the pipe guide 32 can be knocked away without any damage occuring if the core barrel or the drill bit would hit the jaws during the withdrawal, which can easily happen since the core barrel is wider than the other drill pipes and the drill bit is somewhat wider than the core barrel.

Four pull rods 38–41 are connected between the jaws 24 and a housing 37. The housing 37 forms a cylinder 42 for a main piston 43 that has a piston rod 44 extending out through the housing 37. The piston rod 44 has an extension sleeve 45, the end face 46 of which takes support against the jaw 25. The sleeve 45 has a shoulder 47 and between shoulder 47 and a surface 48 on the housing 37, a spring 49 in the form of a pile of plate springs 50 is braced. Thus, the housing 37 forms by its surface 48 an abutment element for the spring 49 and the abutment element is fixedly connected to the jaw 24. The sleeve 45 forms by its shoulder 47 an abutment element for the spring and this abutment element is coupled to the jaw 25. Through the sleeve 45, the housing 37 and the pull rods 38–41, the spring 49 is thus braced between the jaws to force them against each other to a position for gripping the drill pipe 19 as shown in FIG. 2. The piston 43 is single acting and when abutting against the end surface 51 of the cylinder 42, it limits the extension of the spring 49. The cylinder 42 can be supplied with pressure oil through a valve 52 so that the piston 43 compresses the spring 49. The sleeve 45 forms a shoulder 53 that will abut against the housing 37 to limit this movement. When the spring 49 is being compressed, the jaws 24, 25 will be moved away from each other by means of weak coil springs 54, 55 that are directly coupled between the jaws 24, 25. When the jaws pivot towards and away from each other, the housing 37 will pivot together with the jaw 24.

The interior of the piston 43 forms a cylinder 56 for a single-acting piston 57 that has a piston rod 58 that extends through a central bore in the piston rod 44 of the piston 43 and its extension sleeve 45. The cylinder 56 can be pressurized through a valve 59 and the pressure can be steplessly adjustable by means of a pressure regulator 60. When the spring 49 has been compressed by the main piston 43, the jaws 24, 25 can therefore be forced together by means of the piston 57 so that the jaws 24, 25 can be used as a brake when letting down the drill. The braking force can easily be adjusted by means of the pressure regulator 60.

If the pipe guide 32 and the rod 27 is removed, the entire device that comprises the jaws 24, 25, the rods 38–41, the housing 37 and the spring 49 can be swung about the rod 26 so that it will be out of the openings 61, 62 in the housing 23 of the pipe holder 23. This makes it possible to pass through the housing 23 of the pipe holder 23 a lining having as large a diameter as the openings 61, 62.

What I claim is:

1. Drill string holder in a rock drilling machine, comprising:

first and second jaws (24,25) mounted opposite each other for receiving a drill string or the like therebetween and for selectively gripping same, a spring (49) operatively coupled between the jaws (24,25) to force them towards each other into their gripping position for gripping the drill string, a first hydraulically actuated piston device (43) operatively coupled to the spring (49) and being selectively actuable to inactivate the spring and permit the jaws to be separated, a second hydraulically actuated piston and cylinder device (56,57) operatively coupled between the jaws (24,25) for forcing them against each other in response to hydraulic pressure acting on the second piston and cylinder device, and means (59,60) coupled to the second piston and cylinder device (56,57) for variably and selectively applying said hydraulic pressure acting on the second piston and cylinder device to vary the force applied thereby to the jaws to force them together when the spring is inactivated.

2. Drill string holder according to claim 1, comprising:

a first abutment element (37,48), tension transmitting means (38–41) coupling the first abutment element to the first jaw (24), and a second abutment element (45,47) that takes support against the second jaw (25), said spring (49) being braced between the first and second abutment elements, and said first piston device (43) being operatively coupled between the first and second abutment elements to pull them towards each other to overcome the spring, thereby rendering the spring inactive and permitting the jaws to separate.

3. Drill string holder according to claim 2, comprising a push rod (58) extending through the two abutment members (37,48; 45,47), and wherein said first piston device (43) is coaxial with the spring (49) and said second piston and cylinder device (56,57) is coaxial with and actuates said second jaw (25) via said push rod (58).

4. Drill string holder according to claim 3, wherein said first piston device comprises a first piston (43) slidable in a cylinder (42) that is formed in said first abutment element (37,48), and said second piston and cylinder device comprises a piston (57) slidable in a cylinder (56) that is formed in said first piston (43).

5. Drill string holder according to claim 4, wherein both of said pistons (43,57) are single acting.

6. Drill string holder, according to claim 1, wherein each jaw comprises a holder with a detachable insert (28,29), the inserts being axially withdrawable in the direction of withdrawal of the drill string (19).

7. Drill string holder according to claim 6, comprising respective snap locks (30) for holding the inserts (28,29) to their respective holders.

8. Drill string holder according to claim 1, wherein a rotatably journalled string guide (32) is mounted to the drill string holder rearwardly of the jaws (24,25), as seen in the feeding direction, said string guide being releasable in the direction of withdrawal of the drill string.

9. Drill string holder according to claim 8, comprising a snap lock (33) releasably mounting the drill string guide (32) to the drill string holder.

10. Drill string holder according to claim 1, wherein both jaws (24,25) are pivotable to and from their gripping positions about axes that are parallel with the drill string.

11. Drill string holder according to claim 10, wherein the pivot axes of the jaws lie in a plane through the drilling axis and at opposite sides thereof.

12. Drill string holder according to claim 1, wherein both jaws (24,25) are movable to and from their gripping positions.

13. Drill string holder according to claim 1 further comprising a drill string guide (32) mounted to the drill string holder, the drill string guide being separate from the jaws (24,25).

14. Drill string holder according to claim 1, wherein said first piston device (43) and said spring (49) and one of the jaws (24) are arranged to pivot conjointly about a common axis.

15. Drill string holder according to claim 14, wherein said first piston device (43) and said spring (49) are operatively mounted on said one of the jaws (24).

16. Drill string holder according to claim 1, wherein the spring (49) comprises of a pile of spring plates (50).

17. Drill string holder according to claim 16, wherein the spring plates are put together in pairs, the two spring plates of each pair flatly engaging each other.

18. Drill string holder according to claim 1, further comprising at least one further spring (54,55) mounted between the jaws to bias them towards their separated position, said at least one further spring (54,55) being weak relative to said first-mentioned spring (49) for forcing the jaws into their gripping position.

19. Drill string holder in a rock drilling machine, comprising: first and second jaws (24,25) mounted opposite each other for receiving a drill string or the like therebetween and for selectively gripping same, a spring (49) operatively coupled between the jaws (24,25) to force them towards each other into their gripping position for gripping the drill string, a first hydraulically actuated piston device (43) operatively coupled to the spring (49) and being selectively actuatable to inactivate the spring and permit the jaws to be separated, and a rotatably journalled string guide (32) mounted to the drill string holder rearwardly of the jaws (24,25), as seen in the feeding direction, the drill string guide being mounted adjacent to the jaws but separate from the jaws, and being releasable in the direction of withdrawal of the drill string.

20. Drill string holder according to claim 19, comprising a snaplock (33) releasably mounting the drill string guide (32) to the drill string holder.

21. Drill string holder in a rock drilling machine, comprising: first and second jaws (24,25) mounted opposite each other for receiving a drill string or the like therebetween and for selectively gripping same, a spring (49) operatively coupled between the jaws (24,25) to force them towards each other into their gripping position for gripping the drill string, a first hydraulically actuated piston device (43) operatively coupled to the spring (49) and being selectively actuatable to inactivate the spring and permit the jaws to be separated, and a drill string guide (32) mounted to the drill string holder, the drill string guide (32) being adjacent to and separate from the jaws (24,25).

22. Drill string holder in a rock drilling machine, comprising: first and second jaws (24,25) mounted opposite each other for receiving a drill string or the like therebetween and for selectively gripping same, a spring (49) operatively coupled between the jaws (24,25) to force them towards each other into their gripping position for gripping the drill string, and a hydraulically actuated piston device (43) operatively coupled to the spring (49) and being selectively actuatable to inactivate the spring and permit the jaws to be separated, said piston device (43) and said spring (49) and one of the jaws (24) being arranged to pivot conjointly about a common axis.

23. Drill string holder according to claim 22, wherein said piston device (43) and said spring (49) are operatively mounted on said one of the jaws (24).

24. Drill string holder in a rock drilling machine, comprising: first and second jaws (24,25) mounted opposite each other for receiving a drill string or the like therebetween and for selectively gripping same, a spring (49) operatively coupled between the jaws (24,25) to force them towards each other into their gripping position for gripping the drill string, a hydraulically actuated piston device (43) operatively coupled to the spring (49) and being selectively actuatable to inactivate the spring and permit the jaws to be separated, and at least one further spring (54,55) mounted between the jaws to bias them towards their separated position, said at least one further spring (54,55) being weak relative to said first-mentioned spring (49) for forcing the jaws into their gripping position.

* * * * *

UNITED STATES PATENT AND TRADEMARK OFFICE

CERTIFICATE OF CORRECTION

PATENT NO. : 4,096,608

DATED : June 27, 1978

INVENTOR(S) : JOHN A. LAGERSTEDT

It is certified that error appears in the above-identified patent and that said Letters Patent are hereby corrected as shown below:

Column 1, line 52, after "plastic" insert --material--;

Column 2, line 35, after "the drill" insert --pipe--.

Signed and Sealed this

*Twenty-third* Day of *January 1979*

[SEAL]

*Attest:*

RUTH C. MASON
*Attesting Officer*

DONALD W. BANNER
*Commissioner of Patents and Trademarks*